United States Patent [19]

King

[11] 4,211,662

[45] Jul. 8, 1980

[54] SYNERGISTIC LUBRICATING COMPOSITIONS

[75] Inventor: James P. King, Upper Gwyneed Township, Montgomery County, Pa.

[73] Assignee: Pennwalt Corporation, Philadelphia, Pa.

[21] Appl. No.: 912,915

[22] Filed: Jun. 6, 1978

[51] Int. Cl.[2] ..... C10M 3/18

[52] U.S. Cl. ..... 252/21; 252/18; 252/25; 252/28; 252/46.4; 252/49.5

[58] Field of Search ..... 252/18, 25, 47, 46.4, 252/21, 28, 49.5

[56] References Cited

U.S. PATENT DOCUMENTS

| | | | |
|---|---|---|---|
| 3,344,065 | 9/1967 | Gansheimer et al. | 252/25 |
| 3,933,657 | 1/1976 | Seni et al. | 252/25 |
| 4,104,179 | 8/1978 | Colclough | 252/47 |
| 4,107,059 | 8/1978 | King et al. | 252/47 |

*Primary Examiner*—Andrew Metz

*Attorney, Agent, or Firm*—R. G. Danehower

[57] ABSTRACT

Lubricating compositions including all types of greases and oils such as cutting oils and rolling oils having enhanced extreme pressure wear properties are provided by including in them as an extreme pressure additive a synergistic mixture of one or more polymers of 1,2,4-and 1,3,4-thiadiazoledithiols and molybdenum disulfide.

9 Claims, No Drawings

SYNERGISTIC LUBRICATING COMPOSITIONS

BACKGROUND OF THE INVENTION

Many lubricants that are adequate for ordinary lubricating applications do not provide sufficient protection under the extreme pressure conditions often encountered in such applications as cutting oils, extrusion lubricants, forging lubricants, and gear and bearing lubricants. Present lubricants used for these purposes are sulfurized and chlorinated hydrocarbon oils and oils containing such additives as iodine, molybdenum disulfide, tungsten sulfide, organic and inorganic lead compounds, heavy metal salts of dialkyldithiocarbamates and dialkyldithiophosphoric acids.

Polymers of 1,2,4-thiadiazoledithiols are described in U.S. Pat. No. 4,107,059 granted Aug. 15, 1978 and these polymers are useful as extreme pressure additives in grease compositions as claimed in that case.

Polymers of 1,2,4-and 1,3,4-thiadiazoledithiols form synergistic lubricating mixtures useful as extreme pressure additives in wire drawing lubricants as disclosed in U.S. Ser. No. 913,177, by J. P. King and A. D. Eckard, entitled Dry Wire Drawing Lubricants Based on Polymers of 1,2,4-and 1,3,4-Thiadiazoledithiols filed on June 6, 1978, 1978.

SUMMARY OF THE INVENTION

I have now discovered an extreme pressure additive for a variety of lubricating base oils and greases. This additive greatly increases the lubricity of these oils and greases under conditions of extremely high load. The extreme pressure additive for the oils and greases is a synergistic mixture of one or more polymers of 1,2,4-and 1,3,4-thiadiazoledithiols and molybdenum disulfide. The synergism is effective in mixtures of 1 to 99% molybdenum disulfide and 99 to 1% of one or more polymers selected from the group of polymers consisting of polymers of 1,2,4-and 1,3,4-thiadiazoledithiols.

The lubricity of a wide range of lubricating base oils and greases is greatly improved by merely adding a friction-reducing amount of the above synergistic composition. The amount of the synergistic mixture used can vary over a wide range depending upon the base lubricant employed and the specific application for which the lubricant is designed. Generally good results are obtained when from about 0.1 to 30 weight percent of the synergistic mixture is added. A preferred useful range of the synergistic mixture is from 0.5 to 20 weight percent of the synergistic mixture.

DETAILED DESCRIPTION OF INVENTION

The lubricating base oils and greases of my invention contain as an extreme pressure additive (E.P.A.), a synergistic mixture of 1 to 99% by weight molybdenum disulfide and from 99 to 1% of one or more polymers selected from the group consisting of polymers of 1,2,4-and 1,3,4-thiadiazoledithiols. This synergistic mixture imparts greater lubricity to the oils and greases than either the molybdenum disulfide or the thiadliazoledithiols polymers used by itself as the sole E.P.A. in the oils and greases.

The presence of the synergistic mixture in the oils and greases enables the lubricants to withstand bearing pressures which would otherwise fail without the synergistic additive. The mixture of molybdenum disulfide and polymers of 1,2,4-and 1,3,4-thiadiazoledithiols constitute from 0.1 to 30% by weight of the mixture of synergistic additive and base oil or base grease, preferably within the range of 0.5 to 20% by weight. The base oils and greases of my invention may contain other extreme pressure additives in addition to my synergistic mixture of molybdenum disulfide and thiadiazoledithiols polymers, but generally they are unnecessary.

The thiadiazoledithiol polymers used in my base oil and grease lubricants have the following structure:

Poly(1,2,4-thiadiazole-3,5-dithiol)

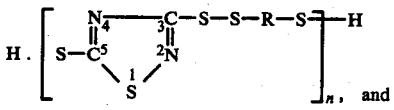

and

Poly(1,3,4-thiadiazole-2,5-dithol)

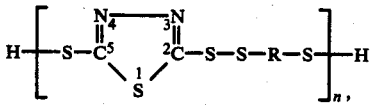

wherein:

R is selected from the group consisting of

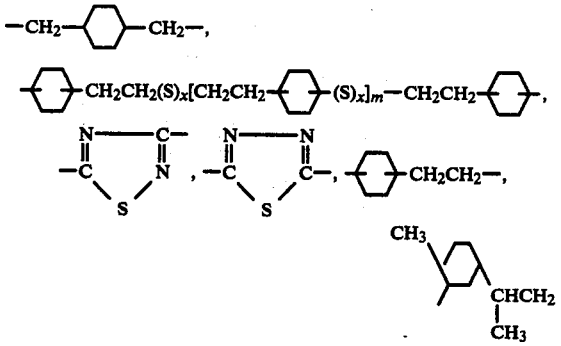

phenylene, biphenylene, and alkylene or substituted alkylene of 2–50 carbons, preferably 2–10 carbons, cyclic alkylene or substituted cyclic alkylene of 5–50 carbons, preferably 6–10 carbons, wherein the alkylene or cyclic alkylene can contain in the chain or ring oxygen and/or sulfur atoms, or $(S)_x$-groups;

m is an integer of 0–10, preferably 1–5;

n is an integer of 5–100, preferably 10–40; and x is an integer of 1–5, preferably 1–2.

For convenience of reference the above polymers will be referred to in the specification as the thiadiazoledithiols polymers.

The preferred polymers of thiadiazoledithiols for use in our lubricant compositions are those based on polymers of 1,2,4-thiadiazoledithiols which appear to have a higher thermal stability. Mixtures of the 1,2,4-and 1,3,4-thiadiazoledithiols polymers are also useful.

The polymers of 1,2,4-thiadiazoledithiols and their preparation are described in U.S. Pat. No. 4,107,059 granted Aug. 15, 1978 which is incorporated herein by reference. The preparation of the polymers of 1,3,4-thiadiazoledithiols is also disclosed in U.S. Pat. No.

4,107,059 granted Aug. 15, 1978 and in Minoura et al (Chemical Abstracts, Volume 68, 96241 g, 1968).

The co-synergist in admixture with the thiadiazoledithol polymers of the invention is molybdenum disulfide. This material occurs in nature as molybdenite and is the principal molybdenum mineral mined. Molybdenum disulfide is quite stable over wide temperature ranges. Its lubricating properties can be explained by its layer lattice structure in which cleavage and shear between laminae is extremely easy. Since molybdenum disulfide is currently in short supply, the substitution of my synergistic mixture for molybdenum disulfide in oils and greases will greatly extend the supply of this critical material.

The major portion of my lubricating compositions will be from 70 to 99.9% by weight of a base oil or base grease. Typical industrial base greases used today are (1) a lithium grease which is mineral oil thickened with a lithium fatty acid such as lithium stearate. A commercial product of this type is Keystone RM 81 light; (2) a clay grease which is mineral oil thickened with clay such as Keystone RM 53; (3) a silicone grease which is silicone oil thickened with lithium fatty acid such as lithium oleate or lithium stearate, (a product of this type is Keystone RM 89); and an aluminum complex grease which is mineral oil thickened with aluminum complex such as Keystone Zeniplex-2.

Oils distilled from napthenic, paraffin and aromatic crude oils and mixtures thereof are suitable bases oils for the greases of my compositions as well as liquid vehicles for the synerigistic mixture of my invention. The oils can range in viscosity from SAE 10 through SAE 250.

The AGMA gear oils 1 through 8 are also suitable lubricant base oils. Machine tool oils, rolling oils and cutting oils are also suitable vehicles for my synergistic mixtures. Water can be mixed with the above oils in an amount to form either water in oil or oil in water emulsions and/or suspensions and provide a water-oil base lubricant for special purposes such as cutting oils and rolling oils.

Synthetic oils are also suitable base lubricants for the molybdenum disulfide-thiadiazoledithols polymer mixture of my invention. These synthetic oils may be of the silicone, organic ester, polyglycol, phosphate esters, polyisobutylene, polyphenyl ether, silicate chlorinated aromatics and the fluorochemical classes.

As mentioned previously, conventional E.P additives may be used in my compositions but generally they would be unnecessary. Other conventional additives can also be used in my oil and grease compositions such as oxidation inhibitors--rust inhibitors--detergents, emulsifiers, dispersants, pour-point depressants--viscosity index improvers and foam inhibitors.

The Shell Four-Ball Extreme Pressure Test machine was selected to evaluate the oil and grease compositions of my invention. This machine is probably the most widely used apparatus for this type of work and results can be readily related to the results of other workers in this field. The Shell Four-Ball EP machine consists essentially of a chuck holding a ½-inch diameter steel ball and a cup holding three similar balls in contact. The chuck holding the one ball is rotated at constant speed for a period of 10 seconds, producing a wear scar on the three immobile balls, a constant load on the balls being applied by means of a pivoted lever. At the end of the 60-second run the balls are removed and the mean wear scar diameter is determined. This load is called the initial seizure load. Beyond this point, small increases in load again produce relatively small increases in the mean wear scar diameter until welding of the balls occur; this load is called the weld point. By obtaining ten wear scar diameters under ten different loads below the weld point, one can calculate the Load-Wear Index (Mean-Hertz Load Index) which is a measure of the ability of a lubricant at applied loads (I.P. Standards for Petroleum and Its Products, Method 239/73T).

The best mode of practicing my invention will be apparent from a consideration of the following Examples in which all percentages are by weight.

EXAMPLES 1 through 5

A lithium grease derived from mineral oil thickened with lithium 12-OH stearate was separately blended with 5% molybdenum disulfide, 5% poly(1,2,4-thiadiazole-3,5 dithiol) (PDTD-124), a mixture of 2.5% molybdenum disulfide and 2.5% poly(1,2,4-thiadiazole-3,5 dithiol) (PDTD-124), and a mixture of 1% molybdenum disulfide and 4% PDTD-124. These four compositions were evaluated by the Shell Four-Ball EP test with the results as shown in Table I.

Table I

Shell Four-Ball Extreme Pressure and Antiwear Characteristics of Lithium Grease and Its Blends

| Example | Lubricant Composition | Extreme Pressure and Antiwear Properties[1] (ASTM D2596) Weld Point, kg | Scar Diameter Before Weld, mm (kg) |
|---|---|---|---|
| 1 | Lithium Grease (base)[2] | 140 | |
| 2 | Lithium Grease (base)[2] + 5% $MoS_2$[3] | 170 | |
| 3 | Lithium Grease (base)[2] + 5% PDTD-124 | 560 | 1.97 (530) |
| 4 | Lithium Grease (base)[2] 2.5% PDTD-124 + 2.5% $MoS_2$ | 710 | 2.29 (665) |
| 5 | Lithium Grease (base)[2] + 1% $MoS_2$ | 665 | 2.17 (620) |
| | Lithium Grease (base)[2] + 4% PDTD-124 | | |

[1]AISI 52100 steel on steel

[2]Lithium Grease (mineral oil thickened with 12-OH stearate, Keystone RM81 light, Keystone Division, Pennwalt Corp.)

[3]Technical grade, Climax Molybdenum Corp.

Examples 4 and 5 clearly demonstrate the synergistic effect of the molybdenum disulfide-thiadiazoledithiols polymers as EP additive.

EXAMPLES 6 through 9

Following the procedure in Examples 1 through 5, a silicone grease was separately blended with 5% molybdenum disulfide, 2.5% of poly(1,2,4-thiadiazole-3,5 dithiol) (PDTD-124) and a mixture of 2.5% molybdenum disulfide and 2.5% PDTD-124. The results are shown in Table II.

Table II

Shell Four-Ball Extreme Pressure and Antiwear Characteristics of Lithium Grease and Its Blends

| Example | Lubricant Composition | Extreme Pressure and Antiwear Properties[1] (ASTM D2596) Weld Point, kg | Scar Diameter Before Weld, mm (kg) |
|---|---|---|---|
| 6 | Silicone Grease[2] | 160 | |
| 7 | Silicone Grease[2] + 5% $MoS_2$[3] | 180 | |
| 8 | Silicone Grease[2] + 2.5% PDTD-124 | 355 | 3.01 (315) |
| 9 | Silicone Grease[2] + 2.5% $MoS_2$ Silicone Grease[2] + 2.5% 2.08 PDTD-124 | 400 | 2.08 (378) |

[1]AISI 52100 steel on steel.
[2]Silicone grease - silicone oil thickened with lithium stearate.
[3]Technical grade - Climax Molybdenum Corp.

Example 9 shows the increased wear efficiency of the synergistic mixture of the invention.

EXAMPLES 10 through 13

Following the procedure of Examples 1 through 5 an aluminum complex grease was evaluated in Examples 10–13. Example 13 shows the synergism of the molybdenum dislufide-poly 1,2,4-thiadiazole-3,5 dithiols EP additive. The results are shown in Table III.

Table III

Shell Four-Ball Extreme Pressure and Antiwear Characteristics of An Aluminum Complex Grease and Its Blends

| Example | Lubricant Composition | Extreme Pressure and Antiwear Properties[1] (ASTM D2596) Weld Point, kg | Scar Diameter Before Weld, mm (kg) |
|---|---|---|---|
| 10 | Aluminum Complex Grease[2] | 126 | |
| 11 | Aluminum Complex Grease[2] + 2.5% $MoS_2$[3] | 150 | |
| 12 | Aluminum Complex Grease[2] + 2.5% PDTD-124 | 250 | 2.13 (224) |
| 13 | Aluminum Complex Grease[2] + 2.5% $MoS_2$ +2.5% PDTD-124 | 266 | 3.25 (250) |

[1]AISI 52100 steel on steel.
[2]Aluminum complex grease - mineral oil thickened with aluminum complex (Keystone Zeniplex-2, Keystone Division, Pennwalt Corp.).
[3]Technical grade - Climax Molybdenum Corp.

EXAMPLES 14 through 17

Following the procedure of the previous Examples a mixture of molybdenum disulfide and poly(1,3,4-thiadiazole-2,5 dithiol) (PDTD-134) was evaluated for wear resistance in a lithium base grease composition. The results are shown in Table IV.

Table IV

Extreme Pressure, and Antiwear Characteristics of a Lithium Grease and its Blends

| Example | Lubricant Composition | Extreme Pressure pressure and Antiwear Properties[1] (ASTM D2596) Weld Point, kg | Scar Diameter Before Weld, mm (kg) |
|---|---|---|---|
| 14 | Lithium Grease[2] | 140 | |
| 15 | Lithium Grease[2] + 5% $Mos_2$[3] | 170 | |
| 16 | Lithium Grease[2] + 2.5% PDTD-134 | 400 | 2.10 (378) |
| 17 | Lithium Grease[2] + 2.5% $MoS_2$ +2.5% PDTD-134 | 530 | 2.01 (500) |

[1]AISI 52100 steel on steel.
[2]Lithium Grease - mineral oil thickened with lithium stearate (Keystone RM81 light, Keystone Division, Pennwalt Corp.).
[3]Technical grade - Climax Molybdenum Corp.

Example 17 shows the synergistic effect of the mixture.

EXAMPLES 18 through 21

In Examples 18 through 21 a base lubricating oil with a mixture of molybdenum disulfide and poly(1,2,4 thiadiazole-3,5 dithiol) was evaluated. The results are shown in Table V. Example 21 shows the synergistic effect achieved with the composition of my invention.

Table V

Shell Four-Ball Extreme Pressure and Antiwear Characteristics of a Mineral Oil and Its Blends

| Ex. | Lubricant Composition | Extreme Pressure and Antiwear Properties[1] (ASTM D2596) Weld Point, kg | Scar Diameter Before Weld, mm (kg) |
|---|---|---|---|
| 18 | Mineral Oil[2] | 140 | |
| 19 | Mineral Oil[2] + 5% $MoS_2$[3] | 170 | |
| 20 | Mineral Oil[2] + 2.5% PDTD-124 | 400 | 2.06 (355) |
| 21 | Mineral Oil[2] + 2.5 $MoS_2$ + 2.5% PDTD-124 | 450 | 2.14 (400) |

[1]AISI 52100 steel on steel.
[2]Solvent refined bright stock, 158 SUS at 210° F.
[3]Technical grade - Climax Molybdenum Corp.

I claim:

1. A synergistic lubricating composition comprising a lubricant selected from the group consisting of base lubricating oils and greases having admixed with the lubricant a friction reducing amount of a synergistic mixture of 1 to 99% weight molybdenum disulfide and 99 to 1% weight of a polymer of thiadiazoledithiols selected from the group consisting of;

Poly(1,2,4-thiadiazole-3,5 dithiol)

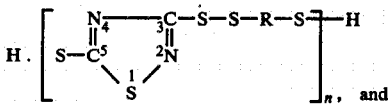

Poly(1,3,4-thiadiazole-2,5 dithiol)

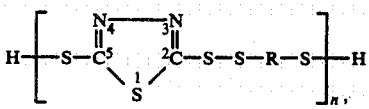

wherein:

R is selected from the group consisting of

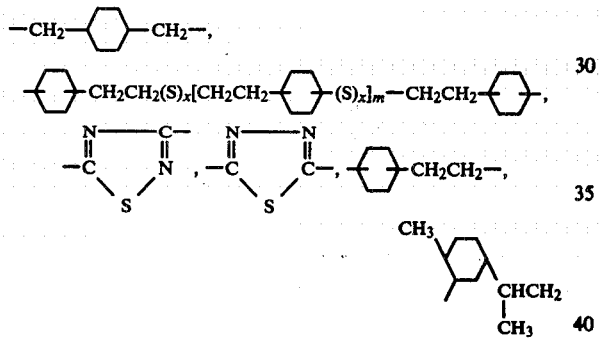

phenylene, biphenylene, and alkylene or substituted alkylene of 2–50 carbons, cyclic alkylene or substituted cyclic alkylene of 5–50 carbons, wherein the alkylene or cyclic alkylene can contain in the chain or ring sulfur atoms, or $(S)_x$-groups;

m is an integer of 0–10, n is an integer of 5–100, and x is an integer of 1–5.

2. The lubricating composition of claim 1 in which the friction reducing amount of the synergistic mixture is present at a concentration ranging from 0.1 to 30% by weight of its combined weights of lubricant and synergistic mixture.

3. The lubricating composition of claim 1 in which the lubricant is a base lubricating oil and the friction reducing amount of the synergistic mixture is present at a concentration ranging from 0.1 to 30% weight.

4. The lubricating composition of claim 1 in which the lubricant is a base lubricating grease and the friction reducing amount of the synergistic mixture is present at a concentration ranging from 0.1 to 30% weight.

5. The lubricating composition of claim 1 in which the polymer of a thiadiazoledithiol is poly(1,2,4-thiadiazole-3,5 dithiol).

6. The lubricating composition of claim 1 in which the polymer of a thiadiazoledithiol is poly(1,3,4-thiadiazole-2,5 dithiol).

7. The lubricating composition of claim 1 in which the lubricant is a base lubricating grease selected from the group consisting of lithium grease, clay grease, silicone grease and aluminum complex grease.

8. The lubricating composition of claim 1 in which the lubricant is a base lubricating oil selected from the group consisting of oils distilled from naphthene, paraffin and aromatic crudes, and synthetic oils.

9. A synergistic lubricating composition comprising a base oil lubricant selected from the group consisting of oils distilled from naphthene, paraffin and aromatic crudes, and synthetic oils having admixed with the lubricant a synergistic extreme pressure mixture of 1 to 99% weight molybdenum disulfide and 99 to 1% weight of a polymer of thiadiazoledithiol selected from the group consisting of:

Poly(1,2,4-Thiadiazole-3,5 dithiol)

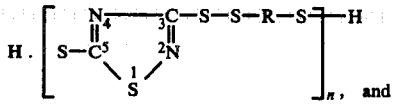

Poly(1,3,4-Thiadiazole-2,5 dithiol)

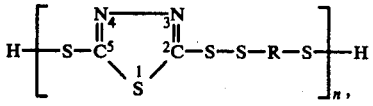

wherein:

R is selected from the group consisting of

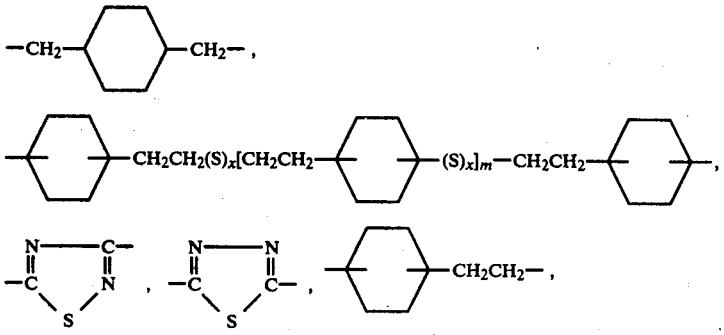

-continued

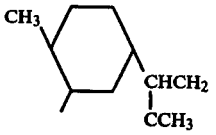

phenylene, biphenylene, and alkylene or substituted alkylene of 2–50 carbons, cyclic alkylene or substituted cyclic alkylene of 5–50 carbons, wherein the alkylene or cyclic alkylene can contain in the chain or ring sulfur atoms, or $(S)_x$-groups:

m is an integer of 0–10 n is an integer of 5–100, and x is an integer of 1–5, the said mixture of base lubricating oil and synergistic E.P. mixture having admixed with it sufficient water to form water in oil or oil in water emulsions.

* * * * *

UNITED STATES PATENT AND TRADEMARK OFFICE

CERTIFICATE OF CORRECTION

PATENT NO. : 4,211,662

DATED : July 8, 1980

INVENTOR(S) : James P. King

It is certified that error appears in the above—identified patent and that said Letters Patent is hereby corrected as shown below:

Col. 1, line 26, should read "6, 1978."

Col. 2, line 19, should read "Poly(1,3,4-thiadiazole-2,5-dithiol)"

Col. 4, line 12, should read "for a period of 60 seconds"

Col. 5, Table II, reads "Silicone Grease[2] + 2,5% 2.08", should read "Silicone Grease[2] + 2.5% PDTD-124"

Col. 5, line 24 (Examples 10 through 13), should read poly(1,2,4-thiadiazole-3,5 dithiols)

Signed and Sealed this

Fourth Day of November 1980

[SEAL]

*Attest:*

SIDNEY A. DIAMOND

*Attesting Officer*

*Commissioner of Patents and Trademark*